United States Patent [19]

Callihan et al.

[11] 3,987,854

[45] Oct. 26, 1976

[54] GRAVEL PACKING APPARATUS AND METHOD

[75] Inventors: Rudy B. Callihan; Jerry W. Meyer, both of Houston; Clyde S. Wainwright, Jr., Bellaire; Bobby B. Taylor, Houston, all of Tex.

[73] Assignee: Baker Oil Tools, Inc., Houston, Tex.

[22] Filed: Feb. 17, 1972

[21] Appl. No.: 227,558

[52] U.S. Cl. ..... 166/278; 166/51

[51] Int. Cl.[2] ..... E21B 43/04; E21B 43/10

[58] Field of Search ..... 166/51, 278, 120, 123, 166/142, 149

[56] References Cited

UNITED STATES PATENTS

| | | | |
|---|---|---|---|
| 2,365,639 | 12/1944 | Holmes et al. | 166/51 |
| 3,126,963 | 3/1964 | Graham | 166/51 |
| 3,134,439 | 5/1964 | Shields, Jr. | 166/51 |
| 3,627,046 | 12/1971 | Miller et al. | 166/278 |
| 3,710,862 | 1/1973 | Young et al. | 166/278 |

*Primary Examiner*—Stephen J. Novosad
*Attorney, Agent, or Firm*—Subkow & Kriegel

[57] ABSTRACT

Apparatus for and method of gravel packing a well, wherein a well liner is run into a well bore on a hydraulically set packer assembly which is releasably supported on a setting tool which provides a fluid flow crossover and seals which are selectively positionable within the packer body and a sealing receptacle in the liner. A ball is dropped to enable pressure to set the packer. The running tool is released and moved upwardly to a circulating position at which fluid can circulate downwardly through the running pipe string and the running tool, through the crossover to the annulus outside the liner to deposit gravel, the fluid flowing upwardly through the crossover and past the packer into the annulus outside of the running pipe string. The running tool is then moved further upwardly to position the seals for reverse circulation of fluid down the annulus outside of the running pipe string and through the crossover into the liner, and then back through the crossover into the running in pipe string. All of the setting, circulating, gravel placement and reverse circulating operations are performed during a single trip of the equipment into the well bore.

23 Claims, 13 Drawing Figures

B
A
51
45
C
65
66
115
37
105
104
D
E
107
108
117
F
114
116
113
H
G
115
108b
E
C
65
66
38
37
D
105
58
51
115
117
127
F
114
G
H
A
45
115a
108b
E
C
65
66
38
58
37
105
117
F
G
H

GRAVEL PACKING APPARATUS AND METHOD

In the production of wells, such as oil and gas wells, that extend into or through sandy, or unconsolidated earth formations, it has been a practice to place a so-called well liner or screen in the well bore and to fill the annulus with gravel which prevents the sand or unconsolidated earth from flowing into the well bore and filling it or being carried to the top of the well in the production fluid.

Customarily, the liner is either landed at the bottom of the well casing or suspended in the casing by a liner hanger. As part of the well treatment, it is desired that a flushing fluid be preliminarily circulated downwardly through a pipe string and into the annulus between the liner and the well bore or casing and then back upwardly through the annulus between the running in pipe string and the casing. Flow of fluid in the same direction as when circulating to flush the annulus outside of the liner is employed to place the gravel material in that annulus. Thereafter, however, it is desired that fluid be reversely circulated to clean out the liner, during which reverse circulation, the fluid flows downwardly through the annulus, then into the liner and back up through the running in string.

To accomplish these several steps or stages in the gravel packing of a well has ordinarily involved the use of complex equipment or running several separate tools or pipe strings at different times, thereby requiring substantial time and expense. A packer must be set to form a seal between the liner and the casing, isolating the annulus above the liner from the annulus below the liner, as well as to, in some cases, suspend the liner at a desired location in the well bore or casing. The crossover assembly may then be run into the packer and liner to enable the conduct of the flushing or circulating, the placement of the gravel and, then, the reverse flushing or circulation. In many cases, a separate production packer is set in the casing following completion of the gravel packing operations.

The present invention provides apparatus for and a method of single trip circulation, gravel packing, and reverse circulation, wherein a packer and well screen or liner are run into a well bore on a running in string, and all of the circulating, gravel placing and reverse circulating operations are performed before removing the running in string. A setting tool and crossover assembly releasably supports the packer and well liner, and after the packer is set and the liner is thereby anchored in the well casing, the setting tool and crossover assembly is manipulated to different positions with respect to the packer and the well liner to locate spaced seals and ports on and in the crossover assembly at adjusted locations with respect to complemental portions of the packer and the well liner. In one position of adjustment, circulation down the running in string and crossover, through the packer and into the annulus outside of the liner can occur, for purposes of flushing the latter annulus and placing the gravel therein. In another adjusted position, the fluid can circulate reversely through the crossover, flowing downwardly through the annulus outside of the running in string, through the packer and a wash pipe into the liner, and returning upwardly through the tubing.

When the setting tool and crossover assembly is removed from the well, the packer assembly constitutes a production packer to which production tubing or a pump may be connected for producing the well fluids which flow through the gravel and the screen or liner into the latter, below the packer. In addition, circulation and gravel placement through the running in string enables flushing with greater speed and eliminates flushing scale and rust from the casing downwardly into the space where the gravel is to be placed.

More particularly, the invention provides a well packer and liner combination wherein the packer is adapted to be set in engagement with the well casing and anchor the liner in place, by means of fluid pressure operating in the setting tool and crossover assembly. After the packer is set, the setting tool is released and the crossover assembly moved upwardly with the setting tool a sufficient distance so that circulation is permitted in one direction. The extent of upward movement is determined by coengagement of releasable stop means which can be released to allow further upward movement of the setting tool and crossover assembly to a location permitting circulation in the other or reverse direction. Then the setting tool and crossover assembly may be removed from the well, or if necessary re-lowered to perform further circulating and/or reverse circulating operations. In its preferred form, the packer is of the retrievable type, so that if desired or necessary, it can be released and removed from the well bore.

The objects of the invention include providing for one-trip gravel packing of a well in an economical manner and with a reliable, safe and versatile apparatus.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense, since the scope of the invention is best defined by the appended claims.

Referring to the drawings.

Figures 1, 2, 3:
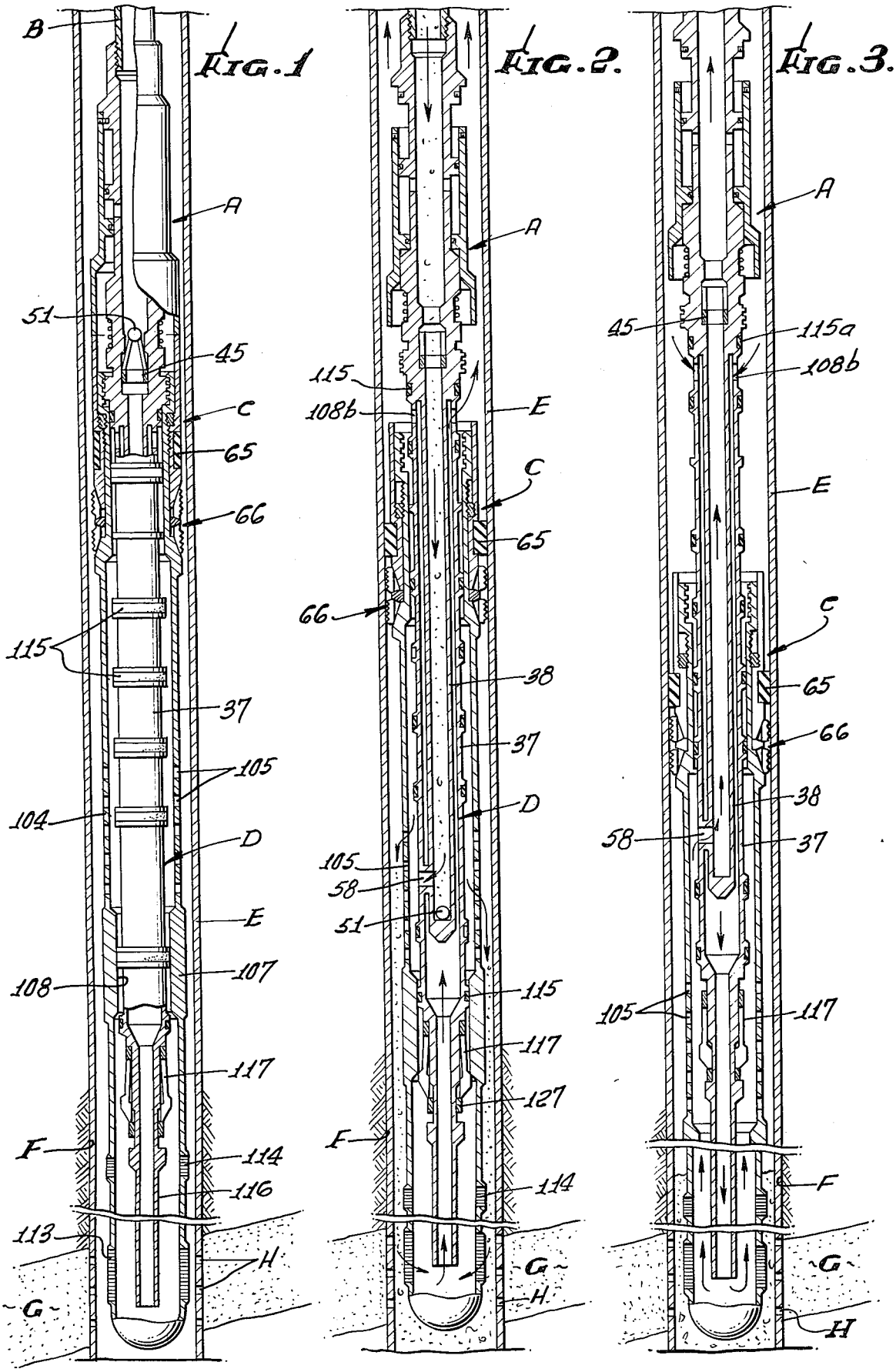
FIG. 1 is a diagrammatic view partly in elevation and partly in vertical section, showing a well liner and packer connected to a setting tool and crossover assembly and run into a well bore in which the liner is to be supported.
FIG. 2 is a diagrammatic view, generally corresponding with FIG. 1, with certain parts further broken away, and showing the packer set in engagement with the well casing, showing the setting tool and crossover assembly positioned for circulating and gravel packing, and showing the casing-liner annulus partially filled with gravel.
FIG. 3 is a diagrammatic view, generally corresponding with FIG. 2, but showing the setting tool and crossover assembly adjusted upwardly to enable reverse circulation.
Figure 4A:
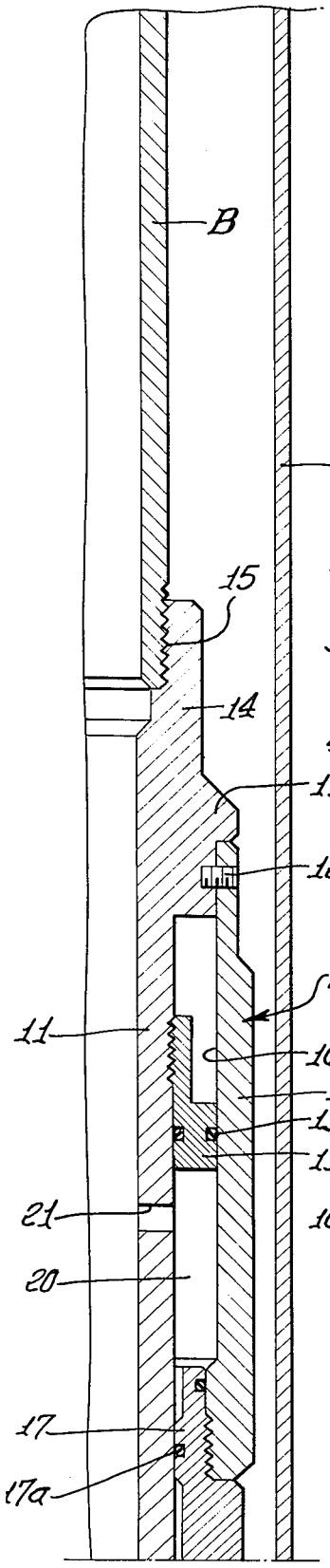
Figure 4B:
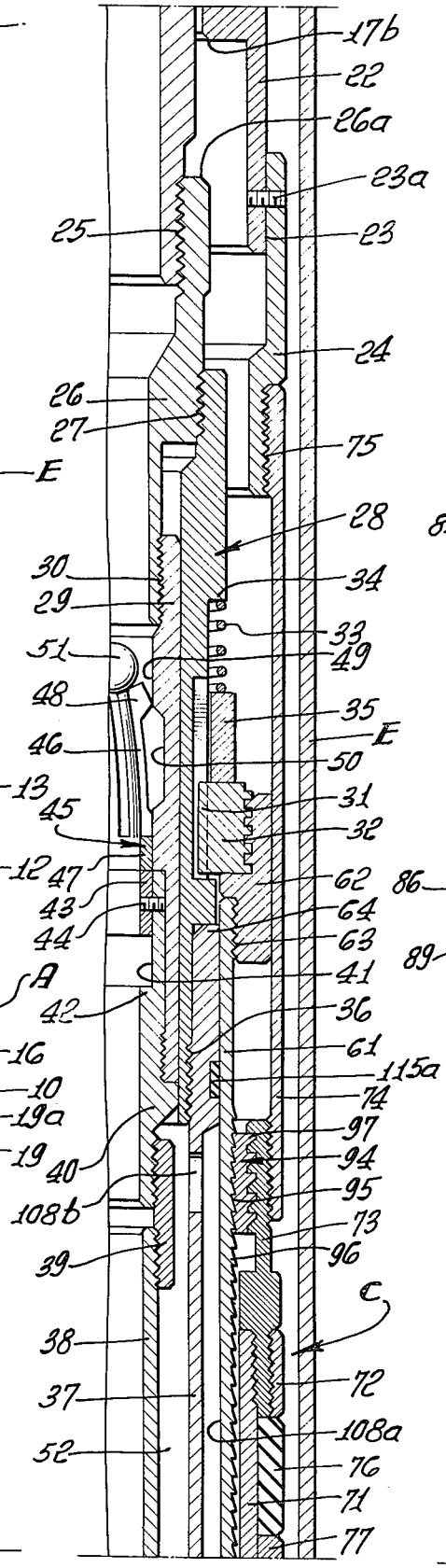
Figure 4C:
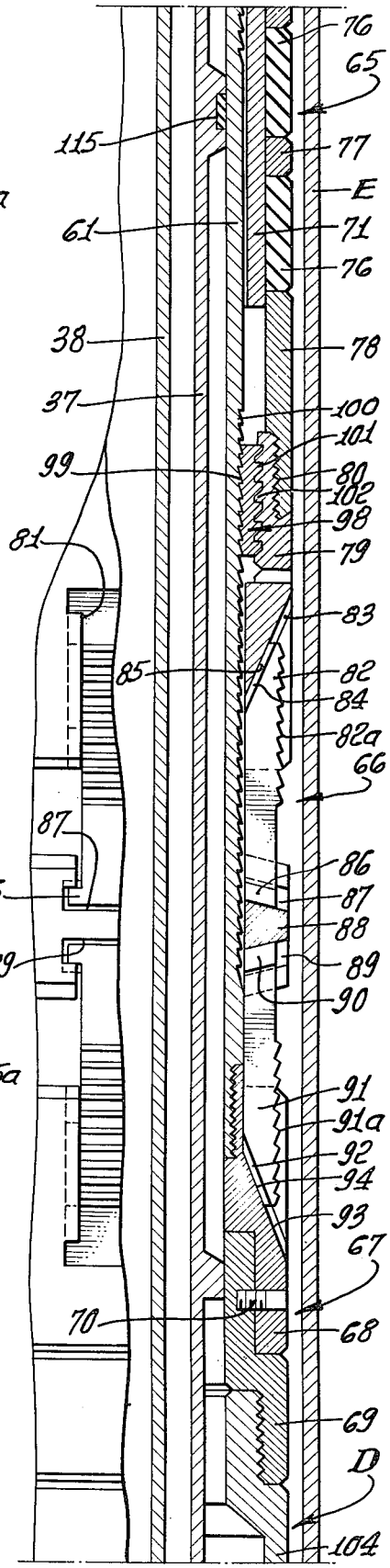
Figure 4D:
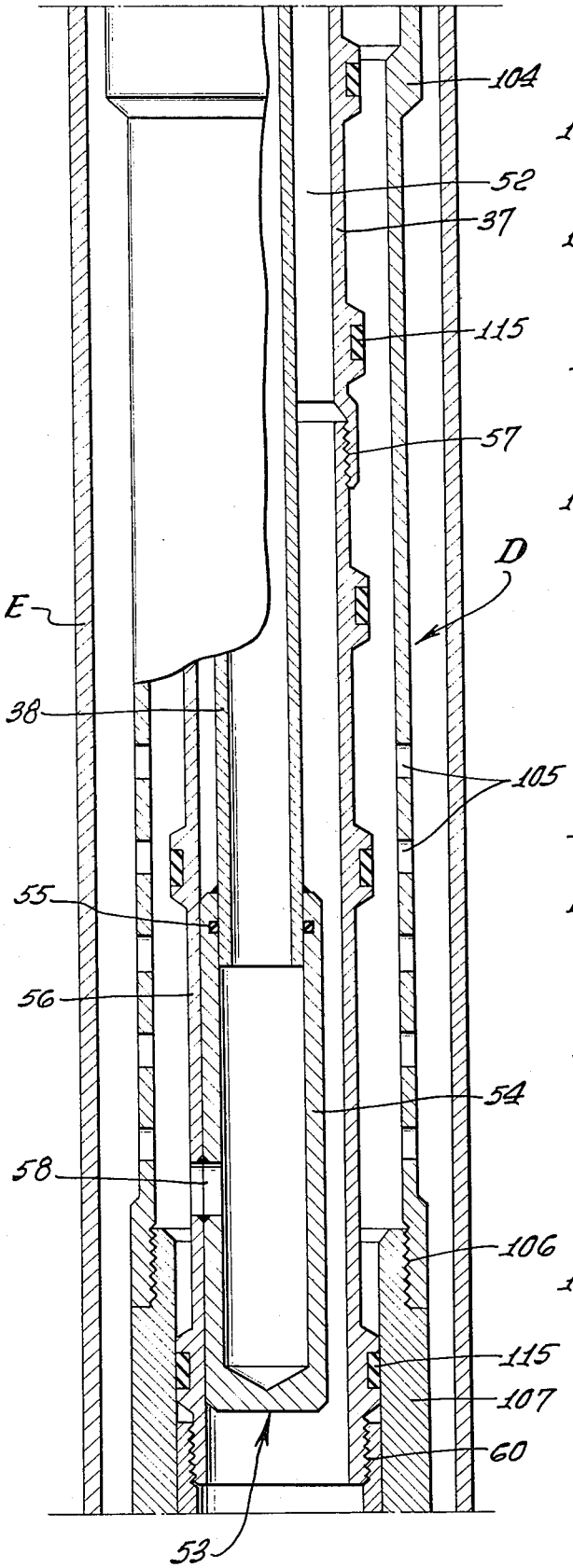
Figure 4E:
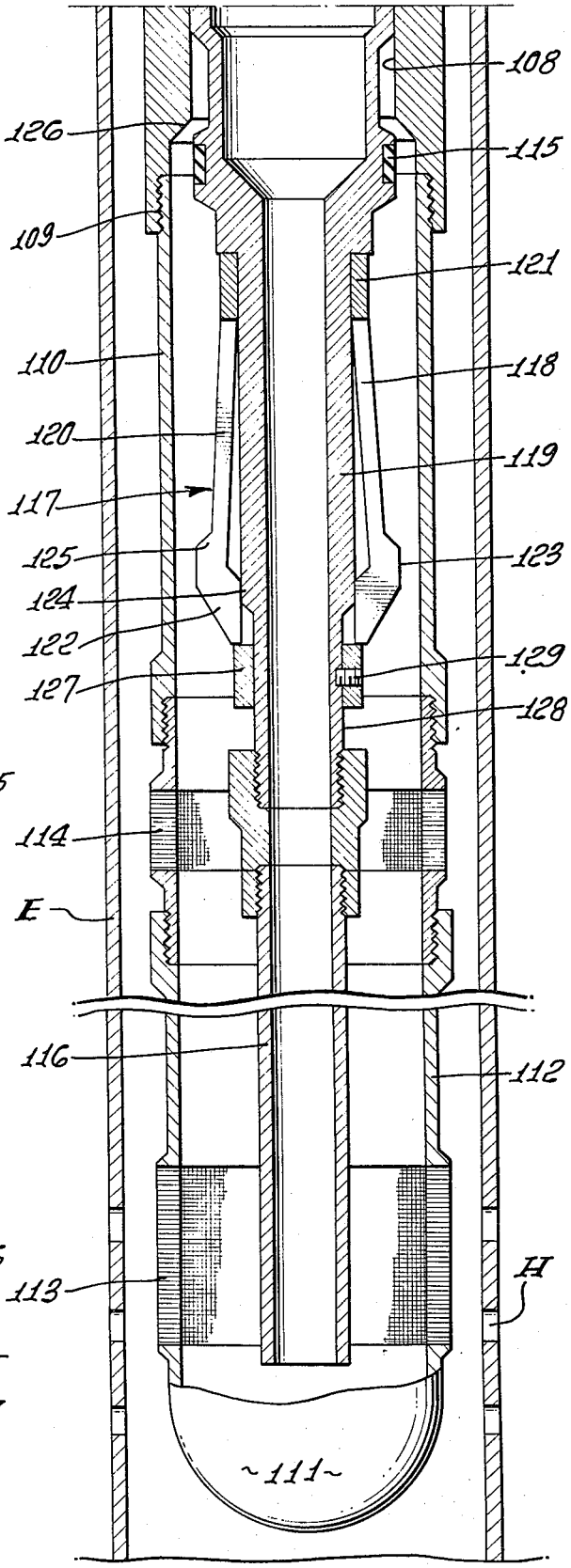
Figure 5A:
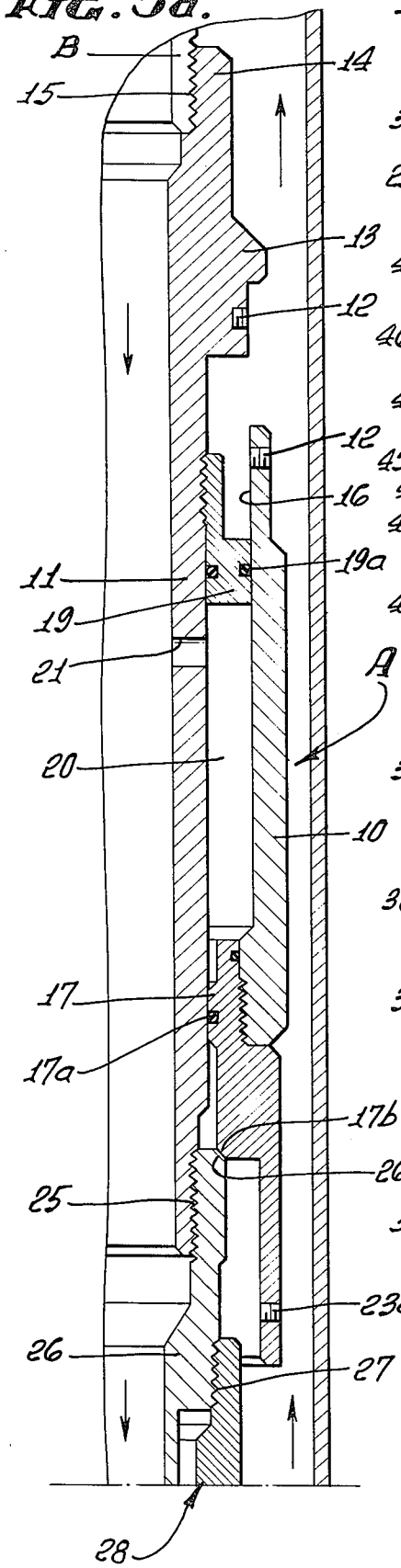

FIGS. 4*a*, 4*b*, 4*c*, 4*d*, and 4*e* together constitute a longitudinal section, with certain parts shown partly in elevation, showing the apparatus in the well casing corresponding with FIG. 1, but illustrating the apparatus in greater detail, FIGS. 4*b* through 4*e*, respectively, constituting successive downward continutations of FIG. 4*a*; and FIGS. 5*a*, 5*b*, 5*c*, 5*d* and 5*e* together constitute a longitudinal section, with certain parts shown partly in elevation, showing the apparatus set in the well casing corresponding with FIG. 2, but illustrating the apparatus in greater detail, FIGS. 5*b* through 5*e*, respectively, constituting successive downward continuations of FIG. 5*a*.

As seen in the drawings, the apparatus of the present invention comprises, in general, a setting tool and crossover assembly A, adapted to be connected at the lower end of a pipe string B and to initially support a well packer C therebelow, with a well screen or liner D extending downwardly from the packer C. The pipe string B is a running in string on which the interconnected setting tool and crossover assembly A and the liner D are adapted to be run into the well casing E which is set in a well bore F extending into or through an earth zone G which is sandy or unconsolidated, so that earth particles or sand would normally tend to flow with the formation fluids into the well bore F through casing perforations H.

The setting tool and crossover assembly A comprises an outer tubular body 10 and an inner tubular mandrel 11 which are releasably connected by frangible means, such as shear screws 12 extending into a head portion 13 of the mandrel 11. At its upper end 14, the mandrel head 13 is threaded at 15 onto the lower end of the running pipe string B. The tubular body 10 has an internal cylinder wall 16 and a lower cylinder head 17 provided with a ring seal 17*a* slidably and sealingly engaged with the mandrel 11. Between the head portion 13 of the mandrel 11 and the cylinder head 17 on the mandrel 11 is an annular piston 19 having a ring seal 19*a* slidably and sealingly engaged with the cylinder wall 16. Thus, there is formed between the cylinder head 17 and the piston 19 a chamber 20 to which fluid is admitted from the mandrel 11 through ports 21. The cylinder head 17 is threaded into the body 10 and has a skirt 22 depending therefrom and connected at 23 by a shear screw 23*a* to a coupling 24, which, as will be later described, effectively connects the body 10 of the setting tool to a component of the packer C to assist in setting the latter and is releasable after the packer C is set.

At the lower end of the mandrel 11, it is threadedly connected at 25 to a coupling 26 which has an outer thread 27 connected with an outer sleeve 28 which extends downwardly in radially outwardly spaced relation to an inner sleeve 29 which is threaded to an inner coupling thread 30. Keyed on the outer sleeve 28 by longitudinally extended key and keyway means 31 is a left-hand threaded nut 32, also adapted, as will be later described, for connection with a component of the packer C, this nut 32 being normally biased downwardly by a coiled spring 23 which abuts with a downwardly facing shoulder 34 on the sleeve 28 and acts downwardly on a thrust washer 35 slidably disposed on the sleeve 28.

At its lower end, the sleeve 28 is connected at 36 with an outer tubular crossover or conduit 37 adapted to extend downwardly through the packer C and into the liner or screen D. An inner, tubular crossover member 38 extends downwardly within the outer member 37 and is connected by a threaded coupling 39 to a lower sub 40 of the inner sleeve 29.

The sleeve sub 40 has a bore 41 forming an upwardly facing shoulder 42, in which a support ring 43 is initially held in an upper position by a shearable set screw 44 engaged in the sub 40. Supported in an upper position in the sleeve 29 by the support ring 43 is a ball seat member 45 composed of resilient fingers 46 extending upward from a bottom ring portion 47 and having ball seat segments 48 on the upper ends of the fingers 46. These seat segments 48 form a substantially circumferentially complete ball seat when the upper ends of the fingers 46 are flexed inwardly by a reduced cylindrical wall 49 within the sleeve 29, as seen in FIGS. 1 and 4*a*, but the fingers 46 will resiliently flex outwardly, as seen in FIGS. 2 and 5*a*, upon downward movement to a position at which the upper ends of the fingers 46 are disposed in a relief clearance 50 provided internally of the sleeve 29.

The ball seat 45 is adapted to be hydraulically displaced downwardly by a fluid pressure in the mandrel 11 when the seat 48 is closed by a tripping ball 51, as will be later described, and when the fingers 46 expand outwardly, the tripping ball can be hydraulically forced downwardly through the seat 45.

The outer crossover member 37 and the inner crossover member 38, previously referred to, define therebetween a space or flow path 52 which communicates at its lower end, FIG. 4*e*, with the screen or liner D. At the lower end of the inner crossover member 38, FIG. 4*d*, is a crossover sub 53 including an inner cup member 54 in the upper end of which the inner crossover conduit is sealingly engaged at 55. The crossover sub 53 also includes an outer tubular member 56 threaded at 57 to the lower end of the outer crossover member 37. The crossover sub members 54 and 56 are welded together and are formed to provide a radial port 58 which establishes communication between the interior of the inner crossover member 38 and the annular space between the liner D and the outer crossover member 37. Extending downwardly in the liner D from the crossover sub 53 is a lower sealing assembly and wash pipe 59 which is connected to the crossover sub 53, as at 60.

The setting tool and crossover assembly, thus far described, is connected to the packer C by the nut 32, and the liner D, as will be later described, is connected to the packer, so that the three can be run into the well as an assembled unit.

Referring more particularly to FIGS. 4*a* and 4*b*, the packer C will be seen to have an inner tubular body 61 to the upper end of which an internally threaded cup or socket member 62 is secured at 63. This cup 62 receives the left-hand threaded nut 32 of the setting tool. A radially projecting shoulder 64 is provided on which the setting tool member 28 lands to limit downward movement of the setting tool and crossover assembly A into the packer body 61.

The body 61 of the packer C extends downwardly within normally retracted but outwardly expansible sealing or packing means 65 and normally retracted but outwardly expansible casing engaging anchor means 66, and at the lower end of the body 61, it is connected to a connector sub or safety joint 67 to which the liner D is also connected. This safety joint 67 includes an upper joint part 68 connected to the packer body 61 and a lower, complemental joint part 69 connected to the liner D, the joint parts 68 and 69 being releasably held against axial separation by a shearable screw 70 which can be sheared to enable the packer C to be removed from the well, even though the liner D may be stuck in the gravel, so that the liner can then be washed over and removed.

The expansible packing means 65 is shown as including a supporting sleeve 71 slidably disposed about the inner body 61 and having at its upper end an abutment ring 72 which is connected to a coupling 73 which is in turn connected to an upwardly extended thrust sleeve 74. At its upper end, the thrust sleeve 74 is connected, as at 75, by the aforementioned coupling 24, to the portion 22 of the body 10 of the setting tool, so as to apply a downward thrust on the packing sleeve 71, when the packer C is being set. Beneath the abutment ring 72 is a number of resiliently deformable rubber or elastomeric packing rings 76 and intervening gauge rings 77, the lowermost packing rings 76 abutting with an abutment ring 78 within which the lower end of the packing sleeve 71 is longitudinally slidable to enable axial deformation of the packing rings 76.

The outwardly expansible anchor means 66, previously referred to, includes a slip carrier 79 connected as at 80 to the abutment ring 78 and having a suitable number of circumferentially spaced, radially and downward opening windows 81 in which a corresponding number of anchor slips 82 are disposed. The slips 82 have downwardly facing teeth or wickers 82*a* to grip the casing. As is customary, these slips 82 are supported by the slip carrier 79 by upwardly and outwardly inclined opposed grooves 83 in the slip carrier and companion ribs 84 on the inner and upper edges of the slips 82, and the slip carrier has an upwardly and outwardly inclined expander surface 85 engageable with the opposing surfaces of the slips 82 to wedge the latter outwardly upon downward movement of the slip carrier 79 relative to the slips 82. At their lower ends, the slips 82 have T-heads 86 engaged in companion T-slots 87 in a clip connector ring 88, this slip connector ring 88 having lower T-slots 89 receiving the T-heads 90 of a set of lower outwardly expansible holddown slips 91. These holddown slips 91 at their inner and lower edges have ribs 92 engaged in downwardly and outwardly inclined slots 93 in a lower, relatively stationary slip expander having downwardly and outwardly inclined wedging surfaces 94, for expanding the slips 91 outwardly as they are moved downwardly relative to the expander. These slips 91 have upwardly facing teeth or wickers 91*a* adapted to grip the casing. Such expansible packing means and expansible slip and expander means are well known and need no further elaboration.

However, preferrably, the packer body 61 and the relatively shiftable coupling 73 and coupling 79 are provided with cooperative latch means for holding the packing means 65 and the anchor means 66 in an expanded condition, unless a retrieving tool is run into the well and engaged in the threaded head 62 to retrieve the packer assembly. In the illustrative packer assembly C, a ratchetting latch 95 has internal teeth 95*a* engaged with opposing teeth 96 on the packer body 61, and the ratchetting latch 94 also has external teeth 97 engaged with the internal teeth of the coupling 73, so that when the packer sleeve 71 moves downwardly with respect to the packer body 61, the latch 95 will ratchet downwardly, but hold the packer sleeve 71 in a downwardly shifted position. Likewise, a ratchetting latch 98 is interposed between the packer body 61 and the coupling 79 and has internal teeth 99 engageable with the external teeth 100 of the packer body 61, as well as external teeth 101 engageable with internal teeth 102 on the connector 79 to hold the slip carrier against upward movement relative to the packer body 61 after the slips 82 and 91 have been expanded into anchoring engagement with the well casing.

As previously indicated, the well screen or liner D is supported beneath the packer C by the safety joint 67 and in the illustrated embodiment, the liner D includes an elongated tubular upper body section 104 having suitably longitudinally and circumferentially spaced radial ports 105 communicating between the upper body member 104 and the well casing E.

Connected at 106 beneath the upper liner body 104 is a tubular sealing receptacle 107 having an internal cylindrical sealing surface 108. Connected at 109 to the lower end of the receptable 107 is a downwardly extended tubular body 110 which terminates at its lower end in a bull plug shoe 111. Spaced vertically within the tubular body 110 by means of a spacer section 112 is a well screen section 113 of a desired permeability to allow the transfer of flushing fluids and well fluids, but to block out sand and gravel. A tell-tale screen section 114 is spaced above the screen section 113 for a purpose which will be hereinafter described.

Suitably spaced along the outer crossover member 37 are a number of annular seal means 115 adapted for side sealing engagement with the cylindrical surface 108 of the tubular sealing receptacle 107 and within a corresponding cylindrical sealing surface 108*a* which extends longitudinally through the packer body 61, these seal means 115 being selectively positionable by relative longitudinal movement between the setting tool and crossover assembly and the packer and liner after the packer and liner have been anchored in the well bore.

In one stage of operation, as will hereinafter be described, it is desired that the setting tool and crossover assembly be moved upwardly sufficiently to allow an upper port 108*b* in the outer crossover member 37 to communicate with the casing E, after removal of an upper seal 115*a* from the packer bore 108*a*, while, the lowermost sealing means 115 precludes communication between the space external of the member 37 and the well liner D below the sealing receptable 107 through which a wash pipe 116 extends downwardly into the liner below the sealing receptacle 107. When the pipe string B is pulled upwardly, the coupling 26 will abut at its upper end 26*a*, as seen in FIG. 5*a*, with the lower end or shoulder 17*b* of the cylinder head 17, causing the shear screw 23ato be sheared and the setting tool to be released from the packer for upward movement. Releasable stop means 117 are provided to facilitate positioning the setting tool and crossover assembly in an initial upper position, as aforesaid, and as seen in FIGS. 2 and 5*a*–5*e*.

This releasable stop mens comprises a collett member 118 disposed about a downward extension 119 of the inner crossover member 38 and having a number of circumferentially spaced resilient fingers 120 joined by a ring 121 and having lower free ends 122 normally holding stop portions 123 of the fingers 120 outwardly, by contact of the ends 122 with an enlarged diameter section 124 of the extension 119. In the outward positions, the fingers 120 provide upwardly facing stops 125 engageable with an opposed downwardly facing shoulder 126 at the lower end of the sealing receptacle 107. The collett device 118 is held in an upper position by a stop ring 127 secured on a reduced diameter section 128 of the extension 119 by a shear screw 129. As will later be described, shearing of the screw 129 enables the device 118 to release the setting tool and crossover assembly for further upward movement. When the stops 125 on the collect fingers 120 are engaged with the opposing stop 126, the lowermost seal means 115 is sealingly engaged within the sealing surface 108 of the receptacle 107, but the uppermost seal 115*a* has moved upwardly (FIG. 5a) to open the upper port 108*a*.

The use of the above-described apparatus for one-trip positioning of a liner, setting of a packer, circulating, gravel packing, and reverse circulation will now be described.

Referring to FIGS. 1 and 4*a* through 4*e*, the apparatus is shown in a running in condition. The packer C and the depending liner D are supported by the setting tool and crossover assembly A, at the left-hand threaded nut 32 which is engaged in the threaded socket 62 at the top of the packer body 61, and the running in pipe supports the setting tool and crossover assembly A in the well casing, so that the liner D is disposed at a desired elevation relative to the formation G and the casing perforations H. A ball 51 is shown engaged with the ball seat member 45 closing the flow path through the setting tool. Pressure can thus be increased in the running in string B until the shear screw 44 releases the ball seat member 45. Before the screw 44 shears, however, the increased pressure in the pipe 13 is applied to the setting tool chamber 20 and acts oppositely on the cylinder head 17 and the piston 19 to produce a relative downward force on the cylinder body 10 which will shear the screws 12. This downward force is then applied to the thrust sleeve 74 which acts downwardly on the packing means 65 and the anchor means 66, while the packer body, which is connected to the mandrel 11 of the setting tool, remains relatively stationary.

Figure 5B:
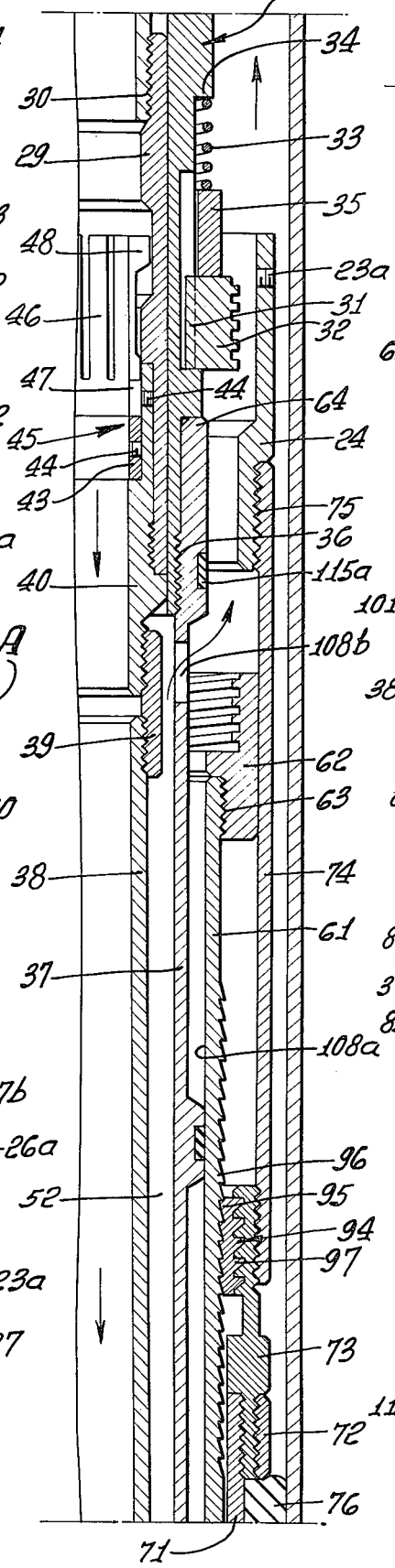
Figure 5C:
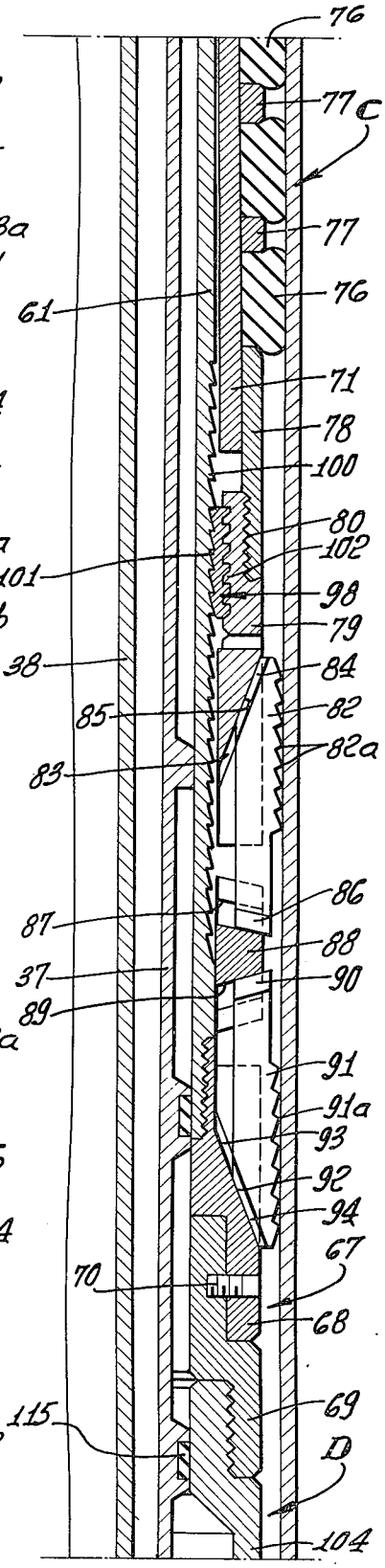
Figure 5D:
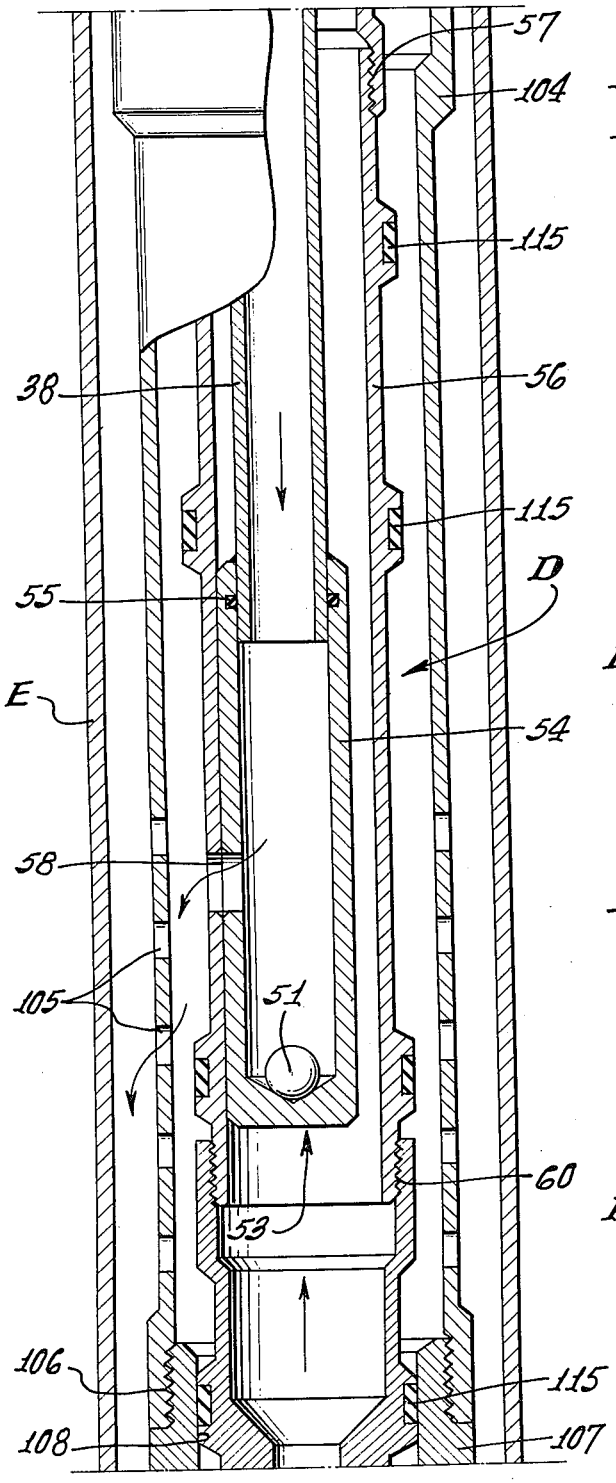

Downward motion from the thrust sleeve 74 is transmitted initially through the packing rings 76 to the anchor means 66, and shifts the slip carrier 79 downwardly relative to the packer body 61, to expand the slips 82 and 91 into opposite anchoring engagement with the casing E, and as the resistance to downward movement of the sleeve 77 increases, the packing rings 76 will be deformed axially and circumferentially into sealing engagement with the casing E, until ultimately the packer means 65 and the anchor means 66 are set in engagement with the casing, as seen in FIGS. 2 and 5*c*. When the packing means 65 and anchor means 66 are set, as just described, the respective latch members 95 and 98 prevent relative opposite motion and retain the packer set in the casing.

The setting of the packer C in the casing occurs before pressure in the running in string B, acting across the ball 51 and the seat member 45, can shear the shear screw 44, but, after the packer has been set, an increase in the pressure in the running in string B will cause the shear screw 44 to be sheared and the seat member 45 will shift downwardly, as seen in FIGS. 2 and 5*b*, and the resilient fingers 46 will expand outwardly to allow the ball 51 to pass therethrough and travel downwardly through the inner crossover member 38 to the closed lower end thereof, as seen in FIGS. 2 and 5*c*.

Figure 5E:
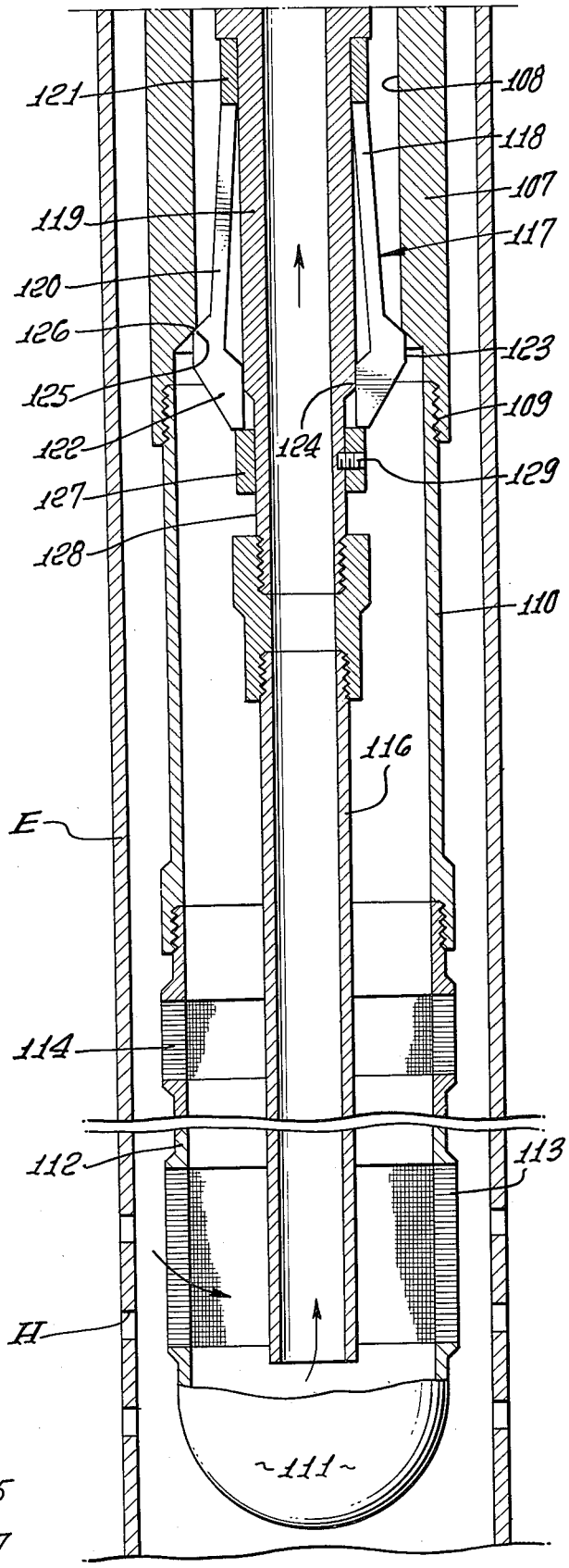

Thereafter, rotation of the running in string B in a right-hand direction will disengage the setting tool and crossover assembly A from the packer, at the left-hand threaded nut 32, as the latter is threaded upwardly on its supporting sleeve 28 from the threaded receptacle or socket 62 at the top of the packer body 61. When the setting tool and crossover assembly is released, the running in string B is elevated until the releasable stop means 117 limits upward travel of the setting tool and crossover assembly, as seen in FIGS. 2 and 5*e*, by abutting engagement of the stop portions 125 on the fingers 120 with the downwardly facing shoulder 126.

With the setting tool and crossover assembly A shifted to the position shown in FIGS. 2 and 5*a*–5*b*, the top seal 115*a* on the crossover assembly is spaced upwardly from the sealing surface 108*a* within the packer body and the port 108*b* communicates between the casing and the space 52 provided between the outer and inner crossover members 37 and 38, respectively. Thus, as shown by the arrows, fluid may be circulated downwardly through the tubing B, the setting tool mandrel 11, and the inner crossover member 38, and then flow through crossover port 58 into the upper body section 104 of the liner D, through ports 105 into the annulus between the casing E and the liner, and thence, inwardly through the screens 113 and 114 of the lower liner section, returning upwardly through the wash pipe 116 into the space 52 between the crossover members 37 and 38, by-passing the packer C and into the casing above the packer C via the ports 108*b*. Such circulation and flushing may be continued as long as desired, and since flow in the casing is in an upward direction, rust and scale removed from the casing will be flushed therefrom, rather than to the bottom of the well.

While the apparatus is in this condition, gravel is placed in the fluid flowing down the pipe string B, and is placed in the well bore outside the liner D, until an increase in back pressure indicates that the upper telltale screen 114 has been covered with gravel.

The next stage of the operation involves taking an upward strain on the running in string B which imposes a shearing force on the shear screw 129 of the stop means 117, so that the setting tool and crossover assembly is free to move further upwardly, whereby the lowermost seal 115 on the crossover assembly is spaced above the sealing receptacle 107, but, the sealing means 115 above the crossover port 58 are sealingly engaged with the sealing surface 108*a* of the packer C. Under these circumstances, reverse circulation is accomplished by pumping fluid downwardly through the casing E, the fluid entering the upper crossover ports 108*b* above the packer C and flowing downwardly in the space 52 between the crossover members 37 and 38, exiting from the wash pipe 116 to flush the interior of the liner clean. The return flow path is into the inner crossover member 38 through the lower crossover port 58, and, thence, upwardly through the setting tool and running in string B.

If further circulation is desired, the running in string need simply be lowered until the setting tool lands on top of the packer assembly. The running in string may then again be elevated to the approximate position for circulating, but the hoist mechanism must be controlled to position the setting tool and crossover assembly, since the stop means 117 will then be inoperative to indicate the proper position of the crossover assembly.

Ultimately, the running in string B is pulled from the well together with the setting tool and crossover assembly A. The packer C then in effect constitutes a production packer, as the well is being produced, to which suitable production tubing, pump, or the like, may be readily attached by running the same into the well on production tubing and latching into the internally threaded socket 62 at the upper end of the packer body 61.

We claim:

1. In apparatus for use in a well bore and adapted to be run into the well bore on a pipe string for circulating a flushing fluid into and from the well bore in an initial direction and placing gravel in the well bore and for reverse circulating fluid placement of the gravel: said apparatus comprising a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position longitudinally spaced from said first position for directing fluid flowing downwardly through said pipe string into the well bore below said packer assembly and above the bottom of said well liner and from said well liner into the well bore above said packer assembly, and upon longitudinal movement of said crossover means to a third position longitudinally spaced from said second position for directing fluid flowing downwardly through said well bore from above said packer assembly into said well liner below said packer assembly and from said liner below said packer assembly into said pipe string above said packer assembly.

2. In apparatus as defined in claim 1, releasable stop means for postioning said crossover means in said second position.

3. In apparatus as defined in claim 1, said flow passages and spaced sealing means including upper and lower crossover ports, upper seal means separating said upper crossover port from the well bore above said packer assembly when said crossover means is in said initial position, said upper crossover port communicating with the well bore when said crossover means is in said second and third position, lower seal means separating said lower crossover port from the lower end of said liner when said crossover means is in said second position, and said lower crossover port communicating with said well liner when said crossover mean is in said third position.

4. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, said setting tool means having means responsive to fluid pressure in said pipe string operable to expand said expansible means of said packer assembly.

5. In apparatus for use in a well bore and adapted to be run into the well bore on a pipe string for circulatingg a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, said setting tool means having means responsive to fluid pressure in said pipe string operable to expand said expansible means of said packer assembly, frangible means normally preventing operation of said setting tool means, and means incorporated in said setting tool means providing a fluid flow path adapted to be closed by a closure member in the fluid in said pipe string for applying fluid pressure in said setting tool means to break said frangible means and operate said setting tool means.

6. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, said setting tool means having piston and cylinder means exposed to the pressure of fluid in said pipe string and operable thereby to expand said expansible means of said packer assembly.

7. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, said setting tool means having piston and cylinder means exposed to the pressure of fluid in said pipe string and operable thereby to expand said expansible means of said packer assembly, frangible means normally preventing operation of said piston and cylinder means, and means forming a path for the flow of fluid between said pipe string and said crossover means closeable by a closure member in said fluid for applying pressure to said piston and cylinder means to break said frangible means and operate said piston and cylinder means.

8. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said wall liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, said setting tool means having means responsive to fluid pressure in said pipe string operable to expand said expansible means of said packer assembly, frangible means normally preventing operation of said setting tool means, incorporated in said setting tool means providing a fluid flow path adapted to be closed by a closure member in the fluid in said pipe string for applying fluid pressure to said setting tool means to break said frangible means and operate the setting tool means, said means forming a flow path including a member shiftable from a position closeable by said closure member to a second position re-opening said flow path following expansion of said expansible means of said packer assembly.

9. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardlly through said well bore from above said packer assembly into said well liner below said packer assembly and from said liner below said packer assembly into said pipe string above said packer assembly, said setting tool means having piston and cylinder means exposed to the pressure of fluid in said pipe string and operable thereby to expand said expansible means of said packer assembly, frangible means normally preventing operation of said piston and cylinder means, and means forming a path for the flow of fluid between said pipe string and said crossover means closeable by a closure member in said fluid for applying pressure to said piston and cylinder means to break said frangible means and operate said piston and cylinder means, said means forming a flow path including a member shiftable from a position closeable by said closure member to a second position re-opening said flow path following expansion of said expansible means of said packer assembly.

10. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assemblly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, said setting tool means having means responsive to fluid pressure to said pipe string operable to expand said expansible means of said packer assembly, frangible means normally preventing operation of said setting tool means, and means incorporated in said setting tool means providing a fluid flow path adapted to be closed by a closure member in the fluid in said pipe string for applying fluid pressure to said setting tool means to break said frangible means and operate the setting tool means, said means forming a flow path including a seating member shiftable from a first position closeable by said closure member to a second position re-opening said flow path, and releasable means initially retaining said seating member in said first position and releasable by fluid pressure to allow movement of said seating member to said second position following expansion of said expansible means of said packer assembly.

11. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, said setting tool means having means responsive to fluid pressure in said pipe string operable to expand said expansible means of said packer aassembly, and means forming a flow path through said setting tool means from said pipe string to prevent pressure operation of said fluid pressure responsive means and closeable by a closure member in fluid flowing therethrough.

12. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, said setting tool means having means responsive to fluid pressure in said pipe string operable to expand said expansible means of said packer assembly, and means forming a flow path through said setting tool means from said pipe string to prevent pressure operation of said fluid pressure responsive means and closeable by a closure member in fluid flowing therethrough, said means forming a flow path including a member shiftable from a position closeable by said closure member to a second position re-opening said flow path following expansion of said expansible means of said packer assembly.

13. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial possition to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, said setting tool means having means responsive to fluid pressure in said pipe string operable to expand said expansible means of said packer assembly, means forming a flow path through said setting tool means from said pipe string to prevent pressure operation of said fluid pressure responsive means and closeable by a closure member in fluid flowing therethrough, said means forming a flow path including a seating member shiftable from a first position closeable by said closure member to a second position re-opening said flow path following expansion of said expansible means of said packer assembly, and releasable means initially retaining said seating member in said first position and releasable by fluid pressure to allow movement of said seating member to said second position following expansion of said expansible means of said packer assembly.

14. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, connector means releasable responsive to right-hand rotation of said pipe string for releasing said setting tool and crossover means from said packer assembly following expansion of said expansible means of said packer assembly.

15. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer asembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, releasable stop means for positioning said crossover means in said second position, including a fixed stop on said well liner and a releasable stop on said crossover means.

16. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly and setting tool and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, releasable stop means for positioning said crossover means in said second positions, including a fixed stop on one of said well liner and crossover means and a releasable stop on the other of said well liner and crossover means.

17. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover mean having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, releasable stop means for positioning said crossover means in said second position, including a fixed stop on one of said well liner and crossover means and a releasable stop on the other of said well liner and crossover means, said releasable stop including means releasable by a pull applied to said pipe string.

18. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passaages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, releasable stop means for positioning said crossover means in said second position, including a fixed stop on one of said well liner and crossover means and a releasable stop on the other of said well liner and crossover means, said releasable stop including a frangible member adapted to be broken by pull applied to said pipe string.

19. In apparatus for use in a well bore and adapted to be run into the well bore on a pipe string for circulating a flushing fluid into and from the well bore in an initial direction and placing gravel in the well bore and for reverse circulating fluid placement of the gravel: a well liner; a packer assembly; means connecting said well liner to said packer assembly; and setting tool and crossover means releasably connected to said packer assembly and extending into said well liner; said packer assembly having means operable by said setting tool means expansible from a retracted position outwardly into sealing and anchoring engagement with the wall of the well bore; said packer assembly, said well liner, and said crossover means having flow passages and spaced sealing means selectively positionable upon movement of said crossover means longitudinally of said packer assembly and well liner from an initial position to a second position for directing fluid flowing downwardly through said pipe string into the well bore below said packer assembly and above the bottom of said well liner and from said well liner into the well bore above said packer assembly, and upon longitudinal movement of said crossover means to a third position for directing fluid flowing downwardly through said well bore from above said packer assembly into said well liner below said packer assembly and from said liner below said packer assembly into said pipe string above said packer assembly, said crossover means comprising an outer elongated tubular member connected to said setting tool means and having an upper laterally opening crossover port, and an inner elongated tubular member disposed in said outer member, means providing a lower crossover port leading exteriorly of said outer member from said inner member, said outer member having said sealing means thereon including an annular seal engageable in said packer assembly above said upper port when said crossover means is in said initial position, said upper port communicating with the well bore when said crossover means is in said second and third positions, and a lower seal below said lower crossover port forming a seal between said crossover means and said liner when said crossover means is in said second position, said lower seal being open when said crossover means is in said third position.

20. In apparatus as defined in claim 19, seal means between said packer assembly and said crossover means for preventing fluid from flowing therebetween when said crossover means is in said second and third positions.

21. In a method of treating a well for production which includes: lowering an operating tool string having connected thereto a packer having a screen supported therebelow into the well bore; seating the packer in sealing position in the well bore above a producing formation therein with the screen in communication with the producing formation; opening a flow path for circulation downwardly past the packer and the screen to the producing formation and upwardly past the screen and the packer to the well surface for treating the well formation; introducing gravel through said circulation flow path into the well bore below the packer exteriorly of the screen to fill the annular space between the screen and the well bore to a point above the screen; removing the operating tool string from the well bore; and establishing a production flow course from the packer to the well surface for conducting well fluids entering said flow course from the producing formation through the gravel pack and screen, the steps of opening the circulation path through the packer and screen by rotational and longitudinal movement of the operating string; removing the operating string from the well bore after the gravel pack has been installed; and introducing a production tubing string into the well bore to sealed engagement with the packer to form the production flow course from the packer to the surface.

22. An operating tool for setting a packer and screen in place in a well and establishing a circulation path through the packer and screen in place including: means for connecting said operating tool to said packer for setting the same in the well; means for establishing a flow path through the packer and screen to the exterior of the screen; means for establishing a circulation path through the packer and the screen downwardly from the surface and upwardly to return to the surface; means for closing off the circulation path; and means for opening the circulation path by rotational and longitudinal movement of an operating string connected to the operating tool.

23. An operating tool of the character set forth in claim 22 wherein said means for connecting said operating tool to said packer includes: means releasably reconnectable with said packer.

* * * * *

UNITED STATES PATENT AND TRADEMARK OFFICE

CERTIFICATE OF CORRECTION

PATENT NO. : 3,987,854

DATED : October 26, 1976

INVENTOR(S) : Rudy B. Callihan, Jerry M. Meyer, Clyde S. Wainwright, Jr., and Bobby B. Taylor It is certified that error appears in the above-identified patent and that said Letters Patent is hereby corrected as shown below:

Claim 1, Col. 9, line 5, after "fluid" insert --after--.
Claim 4, Col. 9, line 51, after "fluid" insert --after--.
Claim 5, Col. 10, line 11, cancel "culatingg" and substitute --culating--.
Claim 5, Col. 10, line 13, after "fluid" insert --after--.
Claim 6, Col. 10, line 50, after "fluid" insert --after--.
Claim 7, Col. 11, line 13, after "fluid" insert --after--.
Claim 8, Col. 11, line 51, after "fluid" insert --after--.
Claim 9, Col. 12, line 24, after "fluid" insert --after--.
Claim 10, Col. 12, line 66, after "fluid" insert --after--.
Claim 10, Col. 12, line 67, cancel "assemblly" and substitute --assembly--.
Claim 11, Col. 13, line 43, after "fluid" insert --after--.
Claim 12, Col. 14, line 10, after "fluid" insert --after--.
Claim 13, Col. 14, line 49, after "fluid" insert --after--.
Claim 14, Col. 15, line 25, after "fluid" insert --after--.
Claim 15, Col. 15, line 57, after "fluid" insert --after--.
Claim 16, Col. 16, line 20, after "fluid" insert --after--.
Claim 17, Col. 16, line 52, after "fluid" insert --after--.
Claim 18, Col. 17, line 17, after "fluid" insert --after--.

UNITED STATES PATENT AND TRADEMARK OFFICE

CERTIFICATE OF CORRECTION

PATENT NO. : 3,987,854

DATED : October 26, 1976

INVENTOR(S) : Rudy B. Callihan, Jerry M. Meyer, Clyde S. Wainwright, Jr., and Bobby B. Taylor It is certified that error appears in the above-identified patent and that said Letters Patent is hereby corrected as shown below:

Claim 19, Col. 17, line 50, after "fluid" insert --after--.

Signed and Sealed this

*Twenty-fourth* Day of *September 1985*

[SEAL]

*Attest:*

DONALD J. QUIGG

*Attesting Officer*

*Commissioner of Patents and Trademarks—Designate*